US012721369B2

(12) United States Patent
Faison

(10) Patent No.: US 12,721,369 B2
(45) Date of Patent: Sep. 1, 2026

(54) CIGAR CUTTER ASSEMBLY

(71) Applicant: Todd E Faison, West Bloomfield, MI (US)

(72) Inventor: Todd E Faison, West Bloomfield, MI (US)

( * ) Notice: Subject to any disclaimer, the term of this patent is extended or adjusted under 35 U.S.C. 154(b) by 87 days.

(21) Appl. No.: 18/662,320

(22) Filed: May 13, 2024

(65) Prior Publication Data

US 2025/0302092 A1 Oct. 2, 2025

Related U.S. Application Data

(60) Provisional application No. 63/571,305, filed on Mar. 28, 2024.

(51) Int. Cl.
*A24F 13/26* (2006.01)
*A24F 13/22* (2006.01)
*A24F 19/00* (2006.01)

(52) U.S. Cl.
CPC ..... *A24F 13/26* (2013.01); *A24F 13/22* (2013.01); *A24F 19/0035* (2013.01); *A24F 19/0064* (2013.01)

(58) Field of Classification Search
CPC ..... A24F 13/22; A24F 13/24; A24F 13/26
See application file for complete search history.

(56) References Cited

U.S. PATENT DOCUMENTS 835,912 A * 11/1906 Obermayer ..... A24F 13/26 30/112
838,205 A * 12/1906 Nobs, Jr. ..... A24F 13/26 30/186
1,094,338 A * 4/1914 Leisegang ..... A24F 13/26 131/253
1,096,219 A * 5/1914 Bippart ..... A24F 13/26 30/112
1,111,743 A * 9/1914 Graboff ..... A24F 13/26 30/112
1,124,288 A * 1/1915 Bulman ..... A24F 13/26 7/165
1,166,881 A * 1/1916 Anderson ..... A24F 13/26 30/113
1,269,593 A * 6/1918 Fuller ..... A24F 13/26 30/113
1,504,589 A * 8/1924 Wagner ..... A24F 13/26 30/112
2,201,771 A * 5/1940 Hagelauer ..... A24F 13/24 206/102
2,297,919 A * 10/1942 Scott ..... A24F 13/22 131/237.5

(Continued)

*Primary Examiner* — Boyer D Ashley
*Assistant Examiner* — Richard D Crosby, Jr.
(74) *Attorney, Agent, or Firm* — Patent 360; Barry Choobin

(57) ABSTRACT

An assembly that can be transformed between a cigar cutter and a cigar rest. The assembly includes a central body housing an aperture, the aperture configured to receive a head of a cigar. The assembly includes a left blade unit operably coupled to a left side of the central body and a right blade unit operably coupled to a right side of the central body. Each of the left blade unit and the right blade unit includes a frame; a cutting blade mounted to the frame; and a handle pivotally coupled to the frame through a hinge joint, wherein the hinge joint allows pivoting of the handle up to 90 degrees.

2 Claims, 5 Drawing Sheets

(56) References Cited

U.S. PATENT DOCUMENTS

D183,727 S * 10/1958 Emberton ..... 7/152
5,038,644 A * 8/1991 Delsack ..... B25G 1/043 7/165
5,664,331 A * 9/1997 Yu ..... A24F 13/26 30/241
5,722,430 A * 3/1998 Bentley ..... A24F 13/26 131/249
5,759,120 A * 6/1998 Mathis ..... A63B 57/50 D21/793
5,819,750 A * 10/1998 Moyer ..... A63B 57/50 131/330
5,888,061 A * 3/1999 Reynolds ..... A24F 13/24 131/249
5,940,974 A * 8/1999 Lee ..... A47G 21/02 30/322
5,946,753 A * 9/1999 Roberts ..... B67B 7/16 81/3.55
5,974,669 A * 11/1999 Bertino ..... A24F 13/26 30/151
6,102,047 A * 8/2000 Manderick ..... A24F 13/22 206/101
6,164,286 A * 12/2000 Schad ..... A24F 13/26 30/109
6,708,409 B2 * 3/2004 Yu ..... A24F 13/26 131/253
6,875,013 B2 * 4/2005 Smith ..... F23Q 2/32 131/249
6,994,639 B2 * 2/2006 Parks ..... A63B 57/207 473/406
7,137,204 B2 * 11/2006 Wiste ..... H02G 1/1214 30/90.1
7,306,103 B2 * 12/2007 Dustin ..... A45D 33/20 206/823
10,736,353 B1 * 8/2020 Sharp ..... A24F 13/26
12,369,626 B2 * 7/2025 Yang ..... A24F 13/26
2003/0104881 A1 * 6/2003 Ferrari ..... A63B 57/353 473/408
2003/0188433 A1 * 10/2003 Yu ..... A24F 13/26 30/113
2004/0187880 A1 * 9/2004 Hernandez, III .... A63B 55/408 131/257
2005/0045196 A1 * 3/2005 Russell, II ..... A24F 13/26 131/253
2011/0239467 A1 * 10/2011 Chuan ..... A24F 13/24 83/564
2017/0231271 A1 * 8/2017 Almsberger ..... A24F 13/26 30/113
2018/0303156 A1 * 10/2018 Miudo ..... A24F 13/26
2024/0000139 A1 * 1/2024 Vezina ..... A24F 13/24

* cited by examiner

CIGAR CUTTER ASSEMBLY

CROSS-REFERENCE TO RELATED APPLICATIONS

This application claims priority from a U.S. Provisional Patent Appl. No. 63/571,305, filed on Mar. 28, 2024, which is incorporated herein by reference in its entirety.

FIELD OF INVENTION

The present invention relates to a guillotine-style cigar cutter, and more particularly, the present invention relates to a guillotine-style cigar cutter transformable into a cigar rest.

BACKGROUND

Cigar cutters are tools used for cutting a cigar's cap safely and perfectly. Cigar cutters have become an essential tool for cigar lovers allowing them to cut a cigar's cap quickly and neatly every time. Guillotine-style cigar cutters are one of the most common and preferred types because of their simplicity and effectiveness.

Typically, the design of a guillotine-style cigar cutter includes a central body that houses a circular or oval aperture sized to accommodate cigars of various diameters. Two blades, typically made from high-quality stainless steel, are mounted opposite each other and slide towards the center when the handles, to which the blades are mounted, are actuated. Handles are generally equipped with finger holes to facilitate ease of use and provide a secure grip.

Although guillotine-style cigar cutters are easy to use, traditional guillotine-style cigar cutters are of limited utility. Recognizing the market's demand for more versatile tools, the idea of a multi-utility cigar cutter is both innovative and timely. Developing a cigar cutter that integrates additional functionalities could substantially enhance its appeal and usability.

The guillotine-style cigar cutter(s) are hereinafter referred to as cigar cutter(s)

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a multi-utility cigar cutter assembly that is transformable into a cigar rest.

Another object of the present invention is that the multi-utility cigar cutter assembly is economical.

Still, another object of the present invention is that the multi-utility cigar cutter assembly can accommodate cigars of various diameters.

Yet another object of the present invention is that the multi-utility cigar cutter assembly is of an ergonomic design.

A further object of the present invention is that the overall user experience is enhanced.

Still, a further object of the present invention is that the market appeal is enhanced.

An additional objective of the present invention is that the multi-utility cigar cutter assembly can neatly and efficiently cut a cigar's cap.

Still, an additional object of the present invention is that the multi-utility cigar cutter assembly is compact and portable Disclosed is an assembly that can be transformed between a cigar cutter and a cigar rest, the assembly comprising a central body housing an aperture, the aperture configured to receive a head of a cigar; a left blade unit operably coupled to a left side of the central body; and a right blade unit operably coupled to a right side of the central body. Wherein each of the left blade unit and the right blade unit comprises a frame; a cutting blade mounted to the frame; and a handle pivotally coupled to the frame through a hinge joint, wherein the hinge joint allows pivoting of the handle up to 90 degrees.

In one aspect, disclosed is a method of cutting cigars, the method comprising making an aperture in a central body, the aperture configured to receive a head of a cigar; operably coupling a left blade unit to a left side of the central body; and operably coupling a right blade unit to a right side of the central body, wherein each of the left blade unit and the right blade unit comprises a frame; a cutting blade mounted to the frame; and a handle pivotally coupled to the frame through a hinge joint, wherein the hinge joint allows pivoting the handle up to 90 degrees; inserting the head of the cigar into the aperture of the central body; and squeezing the two handles resulting in splicing of the head of the cigar by the two blades of the left blade unit and the right blade unit.

The method further comprises pivoting the handles of the left blade unit and the right blade unit to be perpendicular to the central body; and placing the cigar on a top of the assembly. Top surfaces of the two frames and the central body forms the top of the assembly.

BRIEF DESCRIPTION OF DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
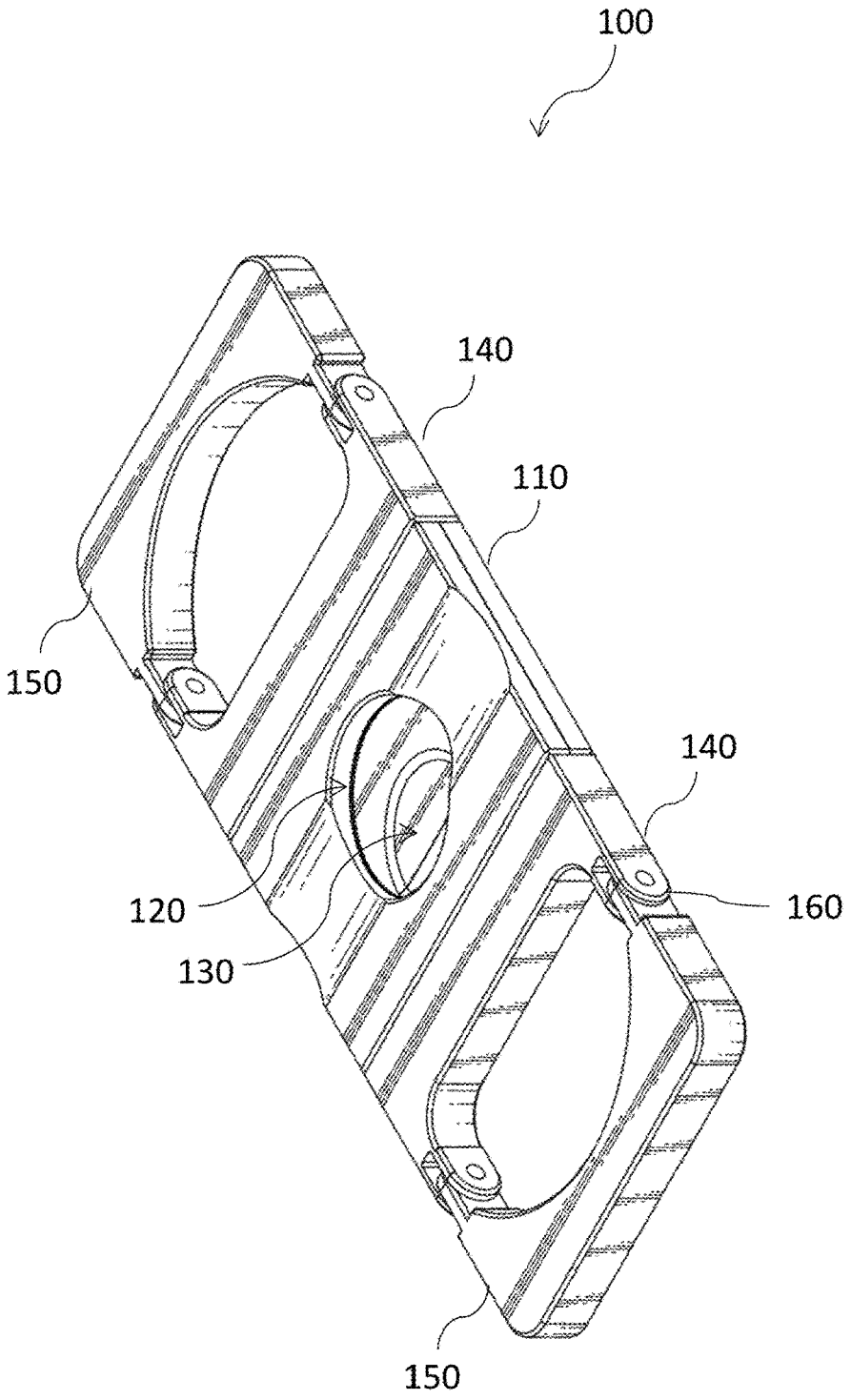
FIG. 1 is a perspective view of a multi-utility cigar cutter assembly, according to an exemplary embodiment of the present invention.
Figure 2:
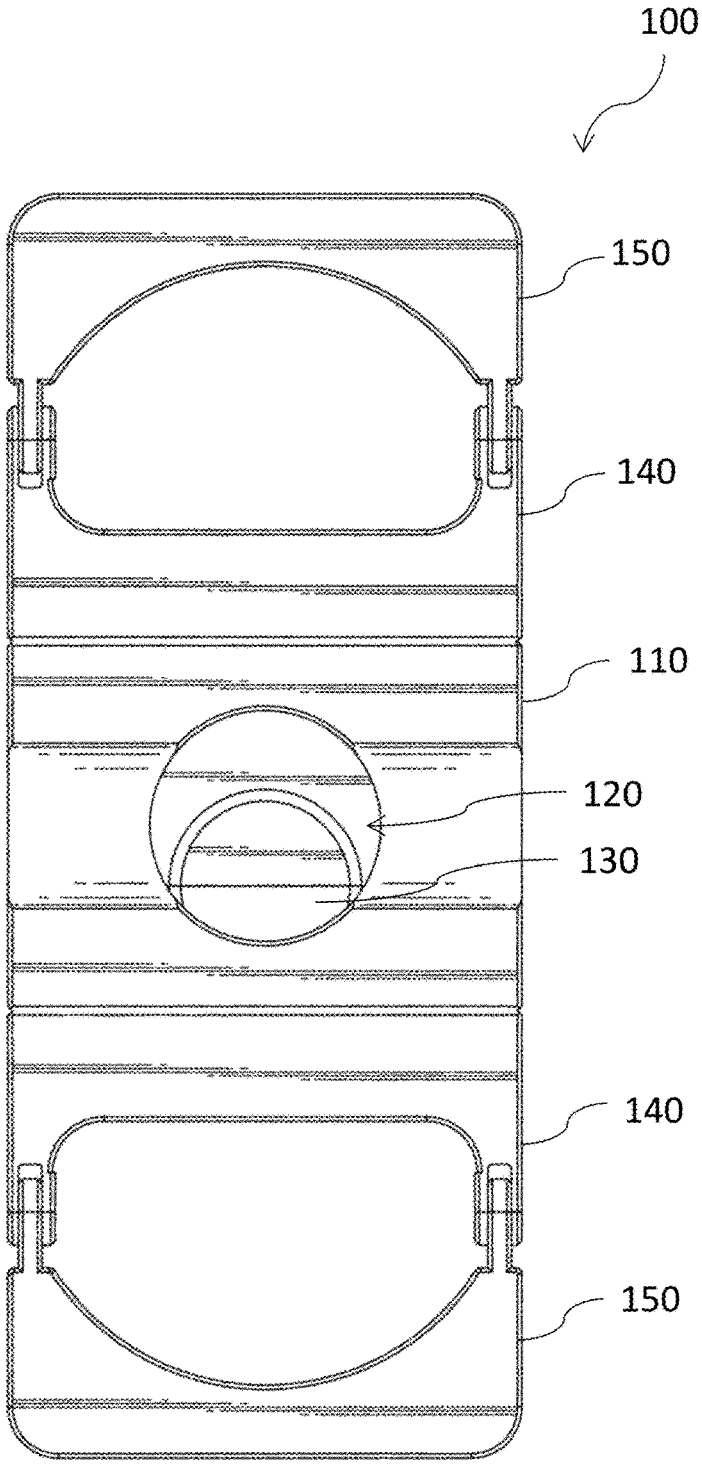
FIG. 2 is a top view of the multi-utility cigar cutter assembly, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Disclosed is a multi-utility cigar cutter assembly that can be quickly and easily transformed between a cigar cutter and a cigar rest. The dual purpose of the cigar cutter assembly represents a significant innovation in cigar accessories. The disclosed dual-purpose multi-utility cigar cutter assembly not only enhances the user experience by consolidating two essential functions into a single compact unit but also offers economic benefits by eliminating the need for two separate tools. The assembly is compact and portable in design allowing it to be easily carried in a pocket or handbag.

The multifunctional aspect of the disclosed cigar cutter assembly that transforms into a cigar rest not only offers convenience but also adds a significant safety feature by mitigating the risk of damage to furniture from burning cigars. The disclosed assembly, transforming into a cigar rest, provides a clean and stable place for the cigar during breaks in smoking. This dual functionality enhances the utility of the assembly, making it an essential tool for cigar enthusiasts.

Referring to FIG. 1 which shows a perspective view of the disclosed multi-utility cigar cutter assembly 100. The multi-utility cigar cutter assembly includes a central body 110 that has a left side, a right side, a front side, a rear side, a top side, and a bottom side. The drawing shows the central body of a substantially cuboid shape, however, the shape can vary without departing from the scope of the present invention. For example, the left and right sides can be flat while the front and rear sides can be curved. The top side can preferably be flat so that a cigar can be stably placed over the top of the central body. The central body can be slightly curved inwards i.e., concave shaped. Also, any cylindrical depressions can be provided on the top surface of the central body for placing the cigars, wherein the dimensions of the cylindrical depressions can correspond to the dimensions of standard-sized cigars, preferably, the largest standard-size cigar. It is to be noted that more than one cigar can be placed over the central body. So, more than one cylindrical depression, spaced apart from each other, can be provided, and any number of such depressions and any shape of such depressions on the top side of the central body are within the scope of the present invention.

In certain implementations, small protrusions can be provided throughout an area of the top side, wherein such protrusions prevent the rolling of a cigar placed upon the top of the central body. Also, the protrusions can be strategically positioned in some areas of the top side of the central body to prevent the rolling of the cigar. Protrusions can be in the form of dots, parallel lines, polygonal designs, and the like.

In certain implementations, a layer of gripping material can also be provided over the top side of the central body. Preferably, such a layer of gripping, if present, can be made from fire-resistant and heat-resistant material. Any other means of grip dispersed over the top side of the central body are within the scope of the present invention.

The central body can be made from a suitable material, such as metal, plastic, rubber, ceramic, wood, and the like, the metal includes alloys. The choice of material may depend on several factors, such as lightweight, heat resistance, durability, aesthetic appearance to appeal to various personal styles, and the like known to a skilled person during development, scaling-up, utilization, and manufacture thereof. For example, Aluminum can be used because of its various advantages like lightweight, durability, ease of manufacture, and various other features. Stainless steel can also be used because of its durability, corrosion resistance, and aesthetic appearance. The use of wood can also provide a good aesthetic appearance and at the same time provides ease in manufacturing.

The central body houses an aperture 120 for receiving a cigar's head. The aperture extends through the top and bottom sides of the central body. The size of this aperture can be proportional to the diameter of a cigar. Preferably, the diameter of this aperture can be larger than the diameter of a standard largest-size cigar. This may allow the use of disclosed assembly for most sizes of cigars commercially available or made available in the future. Thus, the disclosed assembly can be used with cigars of different diameters. The head of the cigar can be inserted into this aperture to splice the cigar's cap. The aperture can be circular or oval, or of any suitable shape sized to accommodate cigars of various diameters.

The central body is hollow in between the top side and the bottom side for accommodating the blades. The blades can slide within this spacing to splice the cigar's cap received into the aperture. This spacing opens on the left side and the right side through which two blades are inserted into the spacing, respectively.

The assembly includes a left blade unit and a right blade unit, both are similar in construction, and both are referred to herein as a blade unit. The blade unit includes a guillotine cutting blade 130 coupled to a frame 140. The cutting blade can be inserted and slid within the spacing in the central body. The edge of the cutting blade can be sharp for easily cutting the cigar head. The shape of the cutting edge may vary provided the cutting edges of two blades correspond to each other. The blades can be made of suitable metal, such as stainless steel, without or without any coatings. The Guillotine cutting blades may have a steep arched angle allowing for a cigar to be cut from.

Figure 3:
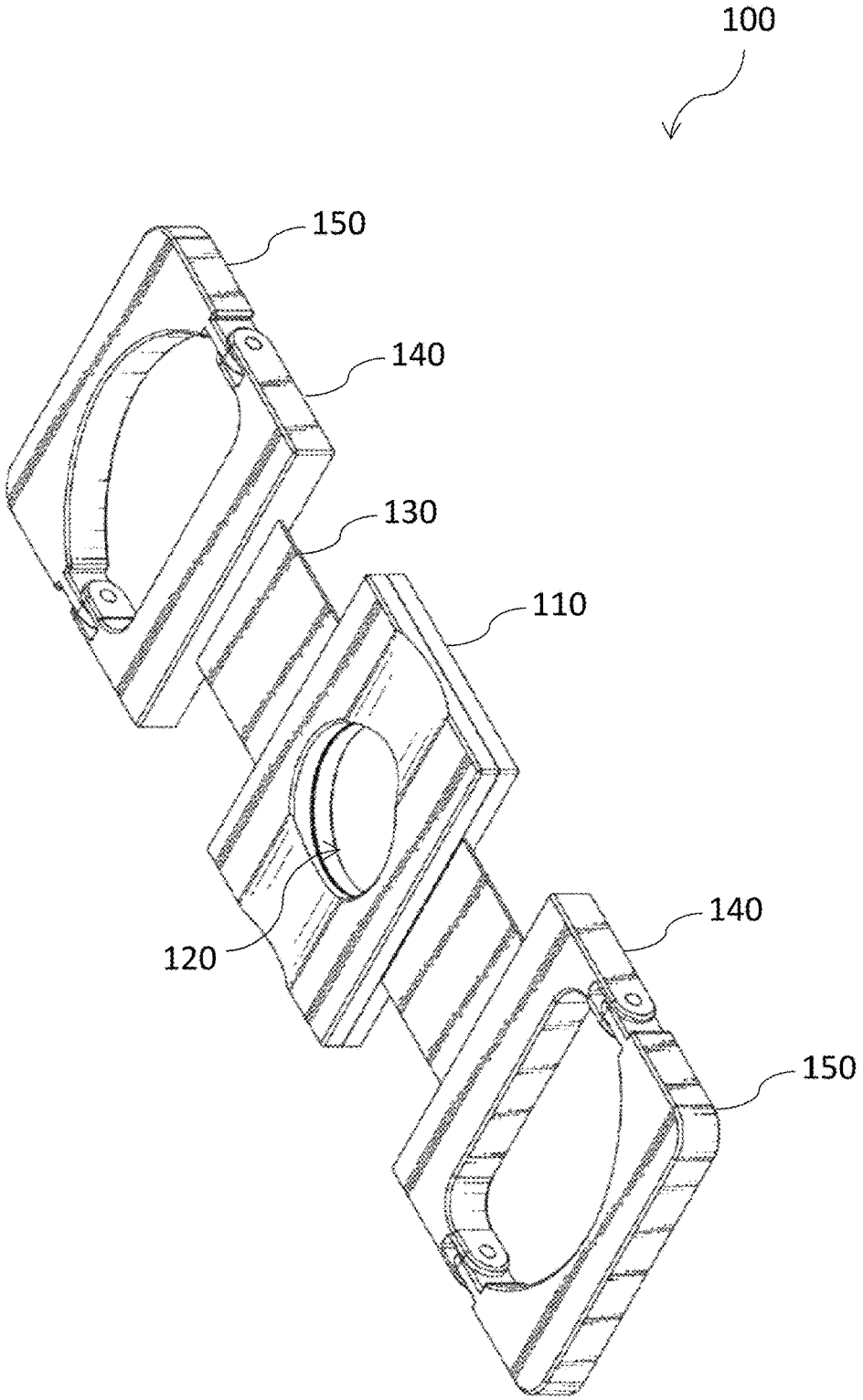
FIG. 3 shows a perspective view of the multi-utility cigar cutter assembly in which left and right blade units are shown retracted, according to an exemplary embodiment of the present invention.

FIG. 3 shows the two blade units retracted from the central body. Also, the frame is clearly shown in FIG. 3. The frame provides support for mounting the cutting blades. As shown in the drawings, the dimensions of the frame can correspond to the dimensions of the central body except the length of the central body. This may allow the top surface of the frame to be continuous with the top surface of the central body. Thus, the central body and two frames together provide a larger area for placing the cigars.

Figure 4:
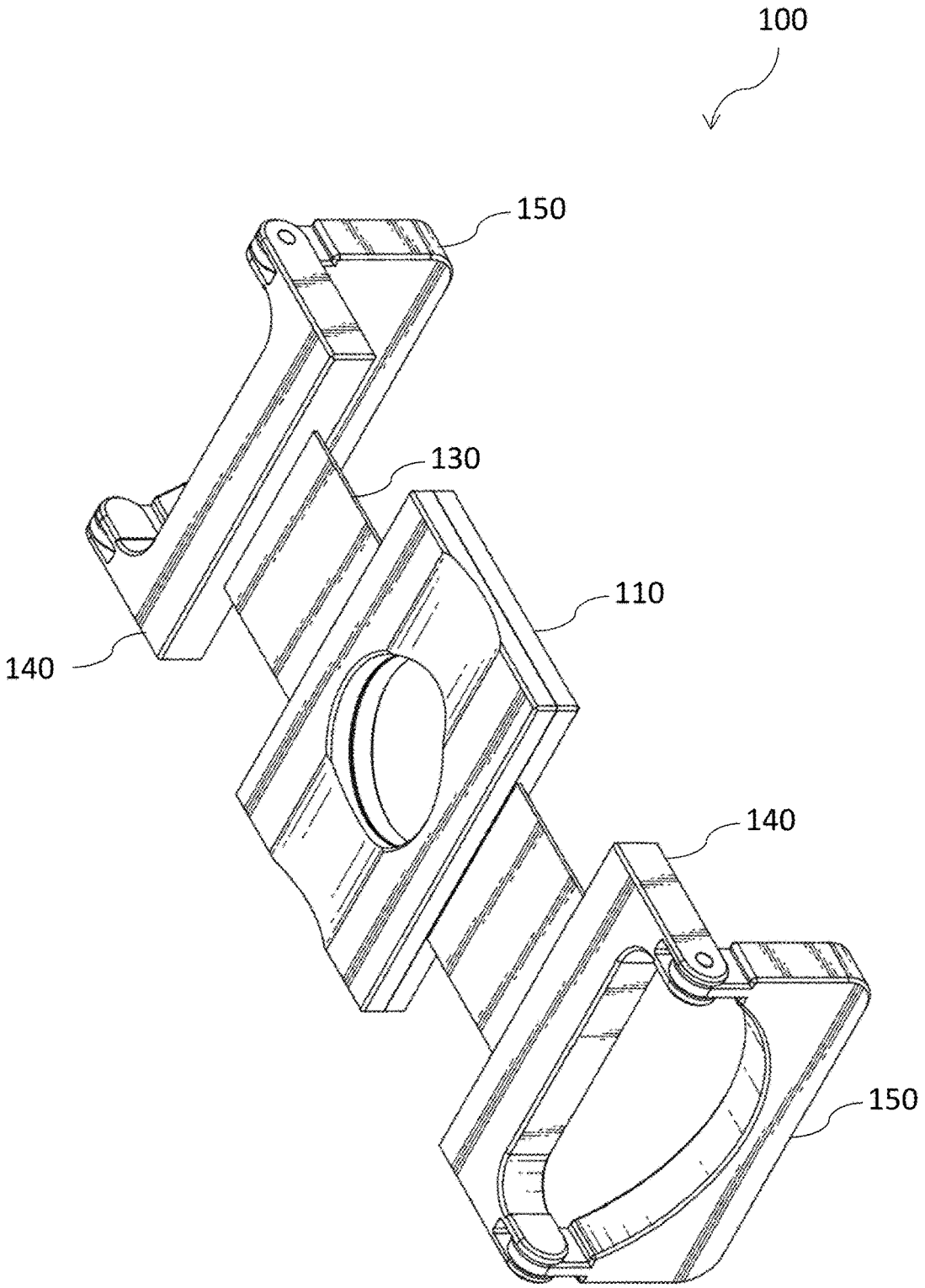
FIG. 4 shows the handles of the multi-utility cigar cutter assembly pivoted perpendicularly, and the blade units in retracted state, according to an exemplary embodiment of the present invention.

The blade unit further includes a handle 150 coupled to the frame 140. The handle is pivotally coupled to the frame using a hinge joint 160. The handle can pivot up to 90 degrees i.e., perpendicularly. FIG. 4 shows the handles pivoting perpendicularly. The hinge joints may allow up to 90-degree rotation of the handles. Moreover, the hinge joints may resist free rotation of the handles. A suitable locking mechanism can also be incorporated to prevent free rotation of the handles. Also, as shown in the drawings, there may be some space between the frame and handle to allow at least a finger or a thumb to pass through. Preferably, four fingers can pass through this space between the frame and handle, so that the handle can be gripped in the hand of the user. The handle can be ergonomically designed to be comfortable in the hand for cutting. The handle is also designed to act as a stable base.

For cutting the cigar's cap, the head of the cigar can be inserted into the aperture. Thereafter, the handles can be squeezed, resulting in the oppositely mounted blades moving towards each other, cleanly slicing off the cap of the cigar.

Figure 5:
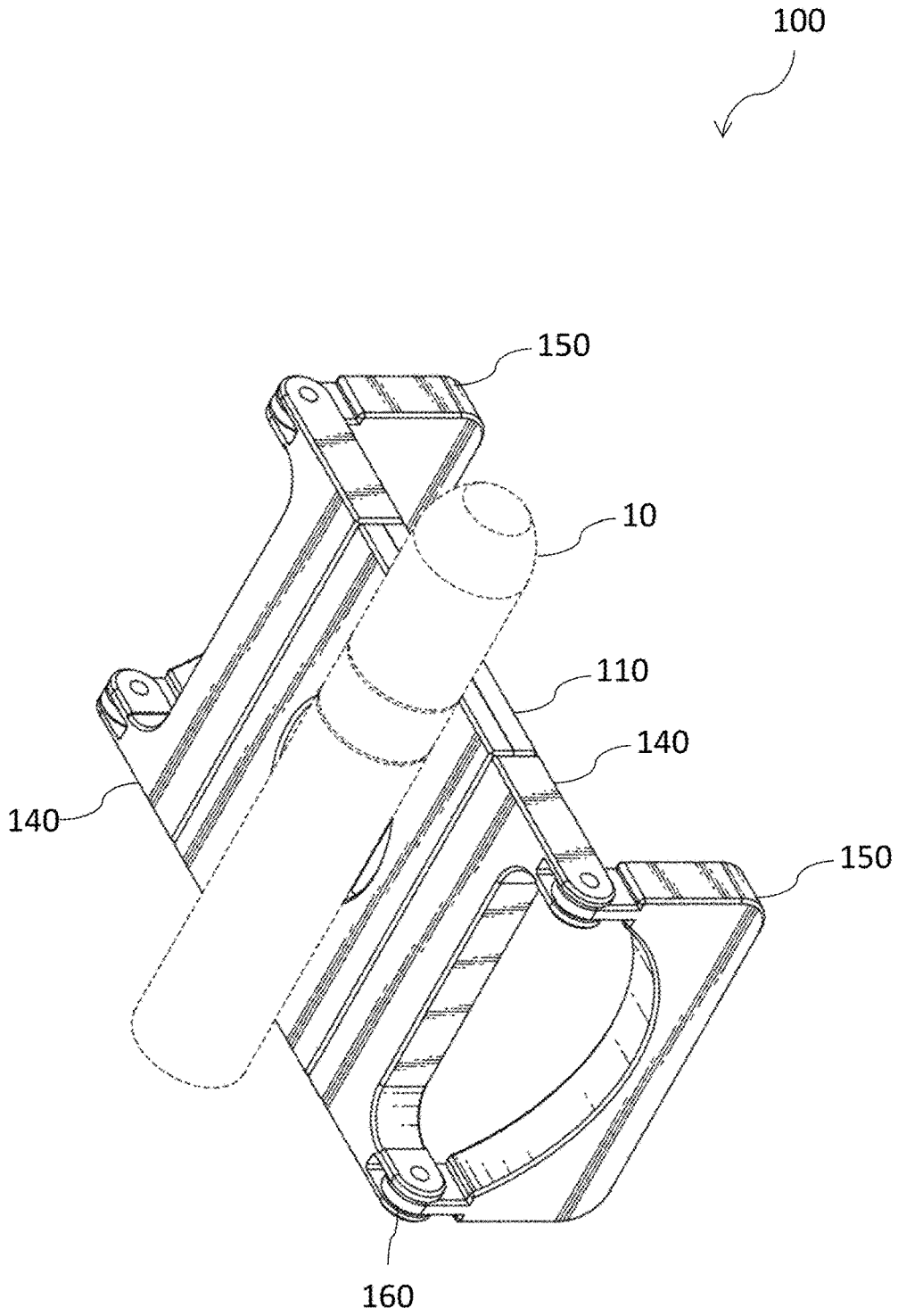
FIG. 5 shows the multi-utility cigar cutter assembly transformed into a cutter rest configuration, according to an exemplary embodiment of the present invention.

For transforming the cigar cutter into the cigar rest, the handles can be pivoted as shown in FIG. 5. The handles pivoted perpendicularly, as shown in FIG. 5, may act as a stable leg, and the central body with the two frames may act as a top, over which the cigars can be placed. FIG. 5 shows a cigar 10 placed on the top of the assembly transformed into a cigar rest configuration.

In certain implementations, the disclosed assembly may also include a self-sharpening feature for maintaining the sharpness of the blades. The assembly may also include a locking mechanism that prevents the blades from opening accidentally. In certain implementations, the central body, the frame, and/or the handles may also include suitable storage compartments. Such storage compartments can be used to store a lighter, spliced cigar caps, and the like.

The disclosed multi-utility cigar cutter assembly can effectively meet the evolving needs of modern cigar lovers, enhancing their experience and offering a level of convenience and functionality that traditional cigar cutters cannot provide. The transformation between the cutter and the rest is facilitated by a hinge joint that is both sturdy and easy to operate. This hinge joint allows the assembly to switch functions smoothly and lock securely in either mode (cutter or rest) to ensure safety and functionality. The disclosed assembly has a user-friendly design that is intuitive to use.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An assembly that can be transformed between a cigar cutter and a cigar rest, the assembly comprising:

a central body housing an aperture, the aperture configured to receive a head of a cigar, the central body is hollow inside;

a depression in a top surface of the central body and extending throughout a width of the central body, the depression is shaped such that to receive the cigar;

a left blade unit operably coupled to a left side of the central body; and a right blade unit operably coupled to a right side of the central body, a left handle pivotally coupled to the left blade unit;

a right handle pivotally coupled to the right blade unit;

wherein each of the left blade unit and the right blade unit comprises:

a frame; and a cutting blade mounted to the frame, wherein the cutting blades are slidably received into the central body;

wherein the left and right handles are configured to pivot downwards opposite to the top surface of the central body for transforming the cigar cutter into the cigar rest, wherein a locking mechanism prevents free rotation of the left and right handles.

2. A method of cutting cigars, the method comprising:

making an aperture in a central body, the aperture configured to receive a head of a cigar, the central body is hollow from inside;

defining a depression in a top surface of the central body, the depression extending throughout a width of the central body;

operably coupling a left blade unit to a left side of the central body; and operably coupling a right blade unit to a right side of the central body, wherein each of the left blade unit and the right blade unit comprises:

a frame; and a cutting blade mounted to the frame, wherein the blades are slidably received within the central body;

pivotally coupling a left handle to the left blade unit;

pivotally coupling a right handle to the right blade unit;

inserting the head of the cigar into the aperture of the central body;

squeezing the left blade unit and the right blade unit resulting in splicing of the head of the cigar by the cutting blades;

after cutting, pivoting the left and right handles downwards opposite to the top surface of the central body to about 90 degrees, wherein a locking mechanism prevents free rotation of the handles; and placing the cigar onto the depression.

* * * * *